US008530734B2

(12) United States Patent
Shoniker

(10) Patent No.: US 8,530,734 B2
(45) Date of Patent: Sep. 10, 2013

(54) DEVICE AND METHOD FOR RHYTHM TRAINING

(76) Inventor: Andy Shoniker, Toronto (CA)

( * ) Notice: Subject to any disclaimer, the term of this patent is extended or adjusted under 35 U.S.C. 154(b) by 0 days.

(21) Appl. No.: 13/182,954

(22) Filed: Jul. 14, 2011

(65) Prior Publication Data

US 2012/0060666 A1 Mar. 15, 2012

Related U.S. Application Data

(60) Provisional application No. 61/364,146, filed on Jul. 14, 2010.

(51) Int. Cl.
*G10H 1/40* (2006.01)

(52) U.S. Cl.
USPC ..... 84/611; 84/609; 84/615; 84/649; 84/651; 84/653; 84/477 R

(58) Field of Classification Search
None
See application file for complete search history.

(56) References Cited

U.S. PATENT DOCUMENTS

| | | | | |
|---|---|---|---|---|
| 6,316,712 | B1 * | 11/2001 | Laroche | 84/636 |
| 7,579,546 | B2 * | 8/2009 | Sumita | 84/611 |
| 7,763,790 | B2 * | 7/2010 | Robledo | 84/483.2 |
| 2002/0148347 | A1 * | 10/2002 | Herberger et al. | 84/636 |
| 2006/0230910 | A1 * | 10/2006 | Song et al. | 84/616 |
| 2008/0034948 | A1 * | 2/2008 | Sumita | 84/636 |
| 2008/0314229 | A1 * | 12/2008 | Robledo | 84/483.2 |
| 2009/0183623 | A1 * | 7/2009 | Mueller | 84/612 |
| 2010/0095828 | A1 * | 4/2010 | Adams | 84/470 R |
| 2010/0263517 | A1 * | 10/2010 | Robledo | 84/483.2 |
| 2010/0319517 | A1 * | 12/2010 | Savo et al. | 84/609 |
| 2011/0252946 | A1 * | 10/2011 | Armstrong | 84/483.2 |
| 2012/0060666 | A1 * | 3/2012 | Shoniker | 84/611 |
| 2012/0192701 | A1 * | 8/2012 | Watanabe et al. | 84/622 |

* cited by examiner

*Primary Examiner* — Marlon Fletcher
(74) *Attorney, Agent, or Firm* — Bennett Jones LLP

(57) ABSTRACT

A programmable rhythm trainer configured to operate on a general purpose computing device including a handheld computing device or a mobile communication device. According to an embodiment, the programmable rhythm trainer comprises a component configured to generate a mix or chain comprising one or more bars and each the bars comprising one or more note arrangements. According to an embodiment, the programmable rhythm trainer comprises a component configured to rearrange one or more of the bars in the chain and save the rearranged chain to memory. According to an embodiment, the programmable rhythm trainer comprises a component configured to rearrange one or more of the note arrangements belonging to one of the bars. According to an embodiment, the programmable rhythm trainer comprises a component configured to set a beats-per-minute for one or more the chains in response to a user input. According to an embodiment, the programmable rhythm trainer comprises a graphical user interface and input for manipulating one or more of the notes, the note arrangements, the bars and/or the chains or mixes. According to an embodiment, the programmable rhythm trainer comprises an application or software program configured to run on computing device. According to another embodiment, the programmable rhythm trainer comprises a portable or handheld device.

10 Claims, 11 Drawing Sheets

DEVICE AND METHOD FOR RHYTHM TRAINING

FIELD OF THE INVENTION

This invention relates to metronomes, and more particularly to a software-based metronome or programmable device that is configured to allow a user to create, edit, manage and/or delete mixes or chains comprising one or more bars of notes.

BACKGROUND OF THE INVENTION

Metronomes are known in the art, and comprise both mechanical (i.e. traditional) and electronic devices. Electronic metronomes are typically limited to providing the functionality of traditional mechanical metronomes.

In the musical arts, greater flexibility and/or programmability are features or functions desired in a metronome or for rhythm training. Accordingly, there remains a need for improvements in the art.

BRIEF SUMMARY OF THE INVENTION

The present invention is directed to a software-based or programmable metronome that can be configured to run on a portable platform or other types of computing platforms or integrated with drum machines, musical effect pedals or panels, or with other types of music control panels, and the like. According to another aspect, the programmable metronome is configured to allow a user to create, edit, manage and/or delete mixes or chains comprising one or more bars of notes.

According to one embodiment, the present invention comprises a programmable rhythm training device configured for a mobile or a handheld device. According to another aspect, the present invention comprises a programmable rhythm training device configured for or integrated with a computing platform, a musical effects device, a drum machine, or other musical device, instrument or machine.

According to another embodiment, the present invention comprises a programmable rhythm training device configured with a mechanism for generating one or more of mixes or chains with bars of arbitrary time signatures.

According to, another embodiment, the present invention comprises a programmable rhythm training device configured with a mechanism for rearranging bars within a mix or chain.

According to another embodiment, the present invention comprises a programmable rhythm training device configured with a mechanism for rearranging one or more note arrangements within a bar.

According to another embodiment, the present invention comprises a programmable rhythm training device configured with a mechanism for substituting note arrangements.

According to another embodiment, the present invention comprises a programmable rhythm training device configured with a mechanism for compressing note arrangements. According to another aspect, the present invention comprises a programmable rhythm training device configured with a mechanism for generating syntactically correct musical notation for compressed note arrangements.

According to another embodiment, the present invention comprises a software-based application or downloadable app for configuring a device as a programmable rhythm training device or a programmable metronome. The application comprises machine readable and executable instructions stored on a computer readable media or storage device.

According to an embodiment, the present invention comprises a programmable rhythm trainer application configured to operate on a general purpose computing device, said programmable rhythm trainer comprising: a component configured to generate a plurality of note arrangements, each of said note arrangements comprising one or more notes; a component configured to arrange said plurality of note arrangements into one or more bars; a component configured to generate a rendering of said one or more bars on a display operatively coupled to the general purpose computing device; and a component configured to play the notes comprising said one or more bars on the display.

According to another embodiment, the present invention comprises a rhythm trainer device having a display and a user input device, said rhythm trainer comprising: a component configured to render a plurality of note arrangements; a component configured to generate one or more bars comprising one or more note arrangements selected from said plurality of note arrangements in response to inputs from the user input device; a component configured to generate a mix comprising a plurality of bars selected from said one or more bars in response to inputs from the user input device; and a component configured to play said mix.

According to another embodiment, the present invention comprises a computer program product stored on a tangible machine readable medium, and comprising computer readable instructions for: generating a rendering of a plurality of note arrangements; arranging said plurality of note arrangements into one or more bars in response to one or more inputs from a user; generating a rendering of said one or more bars; playing said rendering of said one or more bars on a display.

Other aspects and features of the present invention will become apparent to those ordinarily skilled in the art upon review of the following exemplary embodiments of the invention in conjunction with the accompanying figures.

BRIEF DESCRIPTION OF THE DRAWINGS

Reference will now be made to the accompanying drawings, which show by way of example, embodiments according to the present invention, and in which.

Like reference numerals indicate like elements or components in the drawings.

DETAILED DESCRIPTION OF THE EMBODIMENTS

Figure 1:
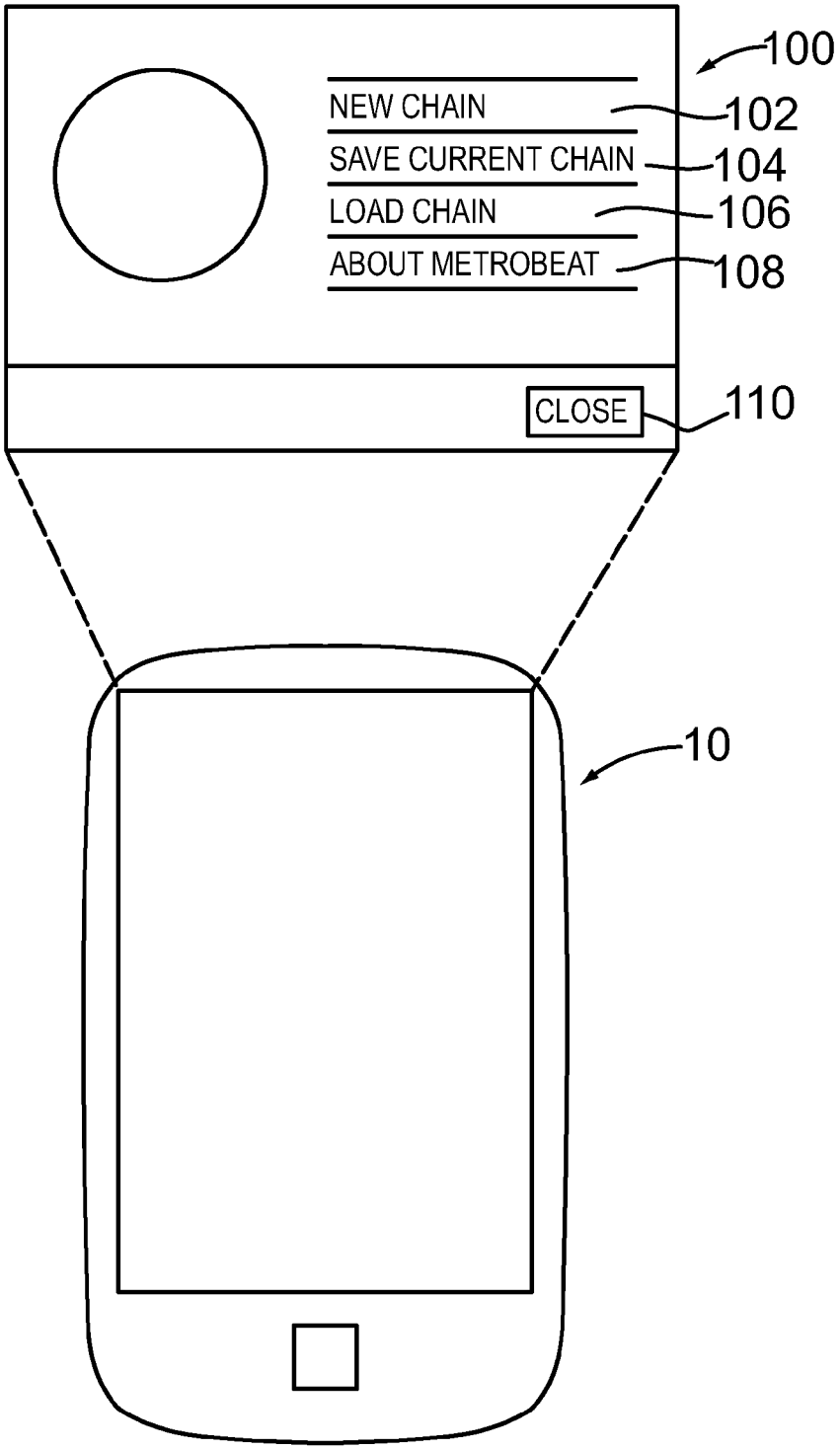
FIG. 1 is a screenshot of a menu screen for a programmable metronome according to an embodiment of the present invention.

The present invention is directed to embodiments of a programmable metronome or rhythm trainer configured to provide the features and functionality as described in more detail below. According to an embodiment, the programmable metronome comprises a computer software based application that is configured for a handheld device such as an iPOD™ device, an iPHONE™ communication device, or an iPAD™ tablet, all from the Apple™ Corporation. According to this aspect, the programmable metronome application is installed as an application or appliance on the device (e.g. an iPHONE™ device) and when invoked or loaded, the iPHONE™ device is configured to operate as a programmable metronome and provide the functionality or features (or a subset therein) as described in more detail below. The programmable metronome application is configured to utilize the display, touch sensitive display, speaker and memory and other resources of the device as described in more detail below. The programmable metronome can also be configured or ported to other computing platforms, or according to another aspect integrated with musical effect pedals or machines.

As will be described in more detail below, the programmable metronome or rhythm trainer is configured to provide a user with the a capability to create "mixes" or "chains", edit, delete and/or manage the mixes or chains. In the context of the present description, a mix or chain comprises one or more "bars", and a bar comprises one or more "note arrangements", and a note arrangement comprises one or more "notes". The bars within a mix or chain can be configured to differ in time signature and composition. The notes can be configured with rests or have accents applied to them. According to one aspect, the programmable metronome is configured to provide the capability to substitute note arrangements of a given duration with a note duration of identical duration, as described in more detail below. According to another aspect, the programmable metronome is configured to provide the capability to rearrange one or more bars within a mix. According to another aspect, the programmable metronome is configured to provide the capability to rearrange one or more note arrangements within a bar. According to another aspect, the programmable metronome is configured to provide a user-configurable BPM (beats-per-minute) setting for each mix. The programmable rhythm trainer is configured to play the mix (i.e. the notes/bars) according to the beats-per-minute setting by scrolling the notes across the display and/or play the notes over a speaker or headphone on or connected to the device. According to another aspect, the programmable metronome is configured to provide the capability for a user to add new bars to an existing chain or mix. The bars can comprise "prepackaged" bars or user defined bars saved in memory. According to another aspect, the programmable metronome is configured to provide the capability to manage mixes or chains, e.g. naming or renaming, saving, and/or deleting.

In the context of the present description, programmable metronome or rhythm trainer refers to the combination of the software-based application loaded or installed on a device or machine, for example, an iPHONE™ device indicated generally by reference 10 in FIG. 1. According to this embodiment, the programmable metronome comprises a combination of software and hardware. The device or machine operates under the control of application (e.g. stored program control) to provide the functionality and features as described herein. The particular coding and implementation details for the various devices and/or computing platforms will be familiar to one skilled in the art.

Reference is first made to FIG. 1, which shows a screenshot of a Menu or main view screen for a programmable metronome 10 (for example, an iPHONE device configured with an application or app according to embodiments of the present invention). The menu screen is indicated generally by reference 100 and according to an embodiment comprises a "New Chain" button or control or object 102, a "Save Current Chain" button or control or object 104, and a "Load Chain" button or control object 106. The Menu screen 100 can also include an "About" button indicated generally by reference 108. As shown, the menu screen 100 can also include a "Close" button or control 110, which is configured to close or exit the programmable metronome running on an iPHONE™ device 10 and return control to the device 10. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 2A:
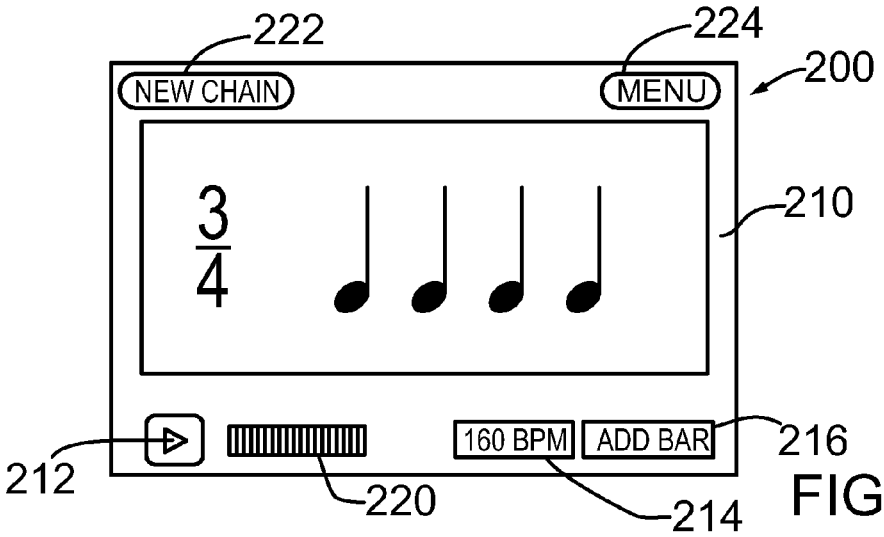
FIGS. 2(*a*) to 2(*c*) are screenshots of a "New Chain" screen configured for generating a new chain or mix according to embodiments of the present invention.
Figure 2B:
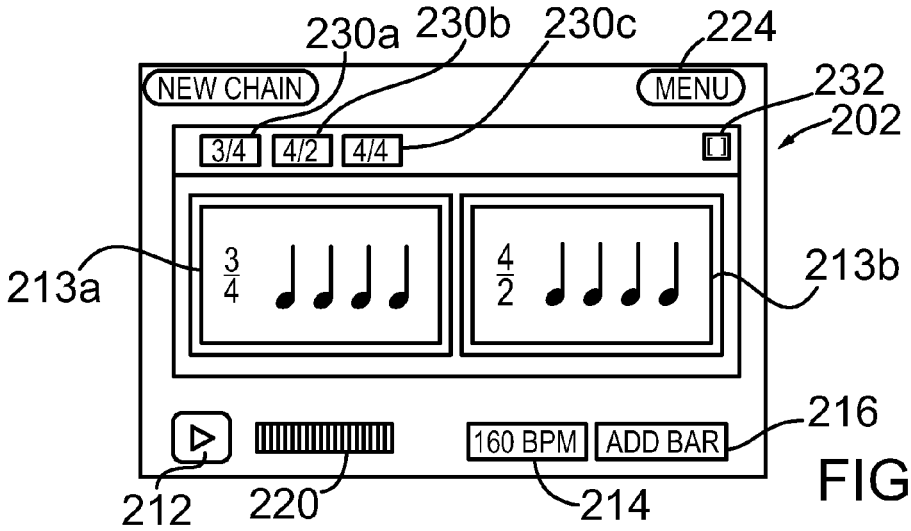
Figure 2C:
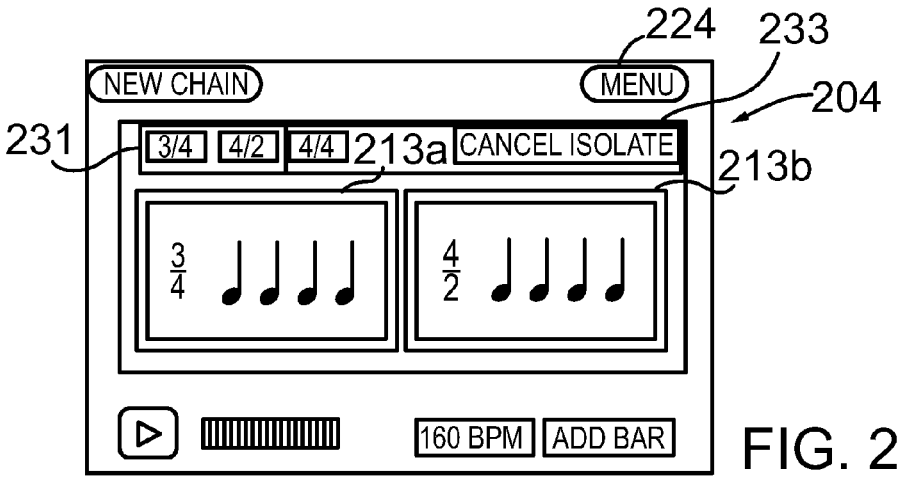

Reference is next made to FIG. 2(*a*), which is a screenshot of a window for viewing a new chain and indicated generally by reference 200. The chain view screen 200 is accessed in response to the New Chain object 102 being activated in the Menu screen 100 (FIG. 1). As shown, the chain view screen 200 comprises a window or panel 210 configured for displaying a chain or mix 211. In this example, the chain 211 comprises a single bar. The chain view screen 200 includes a Play button or control 212, a BPM button or control 214 and an Add Bar button or control 216. The Play button 212 is configured to play the chain or mix (e.g. the beats in the chain or mix), and for a multiple bar mix, the graphical display of the musical notation is scrolled across the display screen of the device 10. The BPM (beats-per-minute) button 214 is configured to access an Edit BPM screen (as described in more detail below with reference to FIG. 8). According to another aspect, the BPM button 214 is configured to display or indicate the current BPM setting, e.g. "160 BPM". As shown, the chain view screen includes a Volume control 220, a title button and display field 222 and a Menu button or control 224. The title display 222 is configured to display the title of the chain. In this case, the chain is new and assigned a default title—"New Chain". As described in more detail below, the programmable metronome is configured to allow a user to set/change the name or title of a chain or mix. The Menu control 224 is configured to allow a user to return to the Menu screen 100 (FIG. 1).

Reference is next made to FIG. 2(*b*), which is a screenshot of a chain view screen 202 configured to display a chain 213 comprising multiple bars with bars 213*a* and 213*b* being displayed. For the multiple bar chain 213, the chain view screen 202 is configured to provide an icon or button 230 for each bar in the chain, indicated individually by references, 230*a*, 230*b* and 230*c*. One of the bars is selected by tapping the bar 213*a*, and the display of the selected bar 213*a* is highlighted, and according to this aspect, the corresponding bar icon 230*a* is also highlighted or activated. As also shown in FIG. 2(*b*), the chain view screen 202 is configured with an isolate bar(s) control indicated by reference 232. According to this aspect, the isolate bar control 232 allows a user to isolate one or more bars, and a corresponding chain view screen 204 for example as shown in FIG. 2(*c*) is generated. For the chain view screen 204, the bars 213*a* and 213*b* have been isolated and the corresponding icons 230*a* and 230*b* are "bracketed" as indicated by reference 231. In the chain view screen 204, the isolate bar(s) control is replaced with a "Cancel Isolate" button or control 233 as shown in FIG. 2(*c*). The Cancel Isolate control 233 is configured to cancel the isolate function in response to activation by the user. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 7:
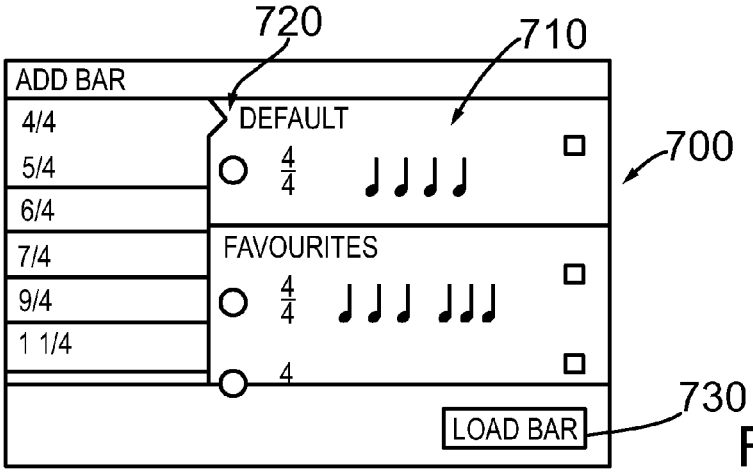
FIG. 7 is a screenshot of an "Add bar" screen according to an embodiment of the present invention.

Referring again to FIG. 2(*a*), in response to actuation (e.g. tapping) of the Add Bar control 216, the programmable metronome is configured to display an Add Bar screen or view as shown in FIG. 7 and indicated generally by reference 700. As shown in FIG. 7 and according to an embodiment, the Add Bar screen 700 is configured with a list of bars 710 comprising prepackaged or default bars and favourites bars. The Add Bar screen 700 includes a scroll control 720 (or other similar navigation control) for scrolling through the list of available bars, and a Load Bar control 730. The Add Bar screen 700 can also be configured with a Recycle tool 740 for editing, i.e. deleting one or more bars from storage or memory. To load a bar into the chain or mix, the user selects on the Favourites, for example, by tapping the desired bar, and then tapping the Load Bar control 730. The programmable metronome 10 is configured to insert the selected bar into the chain, and the bar or chain can be further edited or manipulated as described in more detail below. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 3:
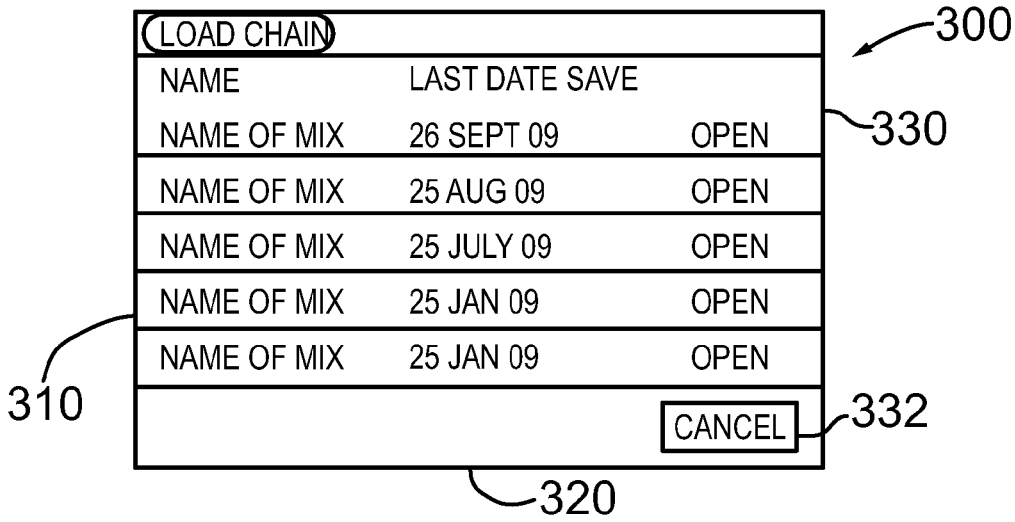
FIG. 3 is a screenshot of a "Load Chain" screen configured for accessing or retrieving saved chain(s) or mixes according to an embodiment of the present invention.
Figure 4:
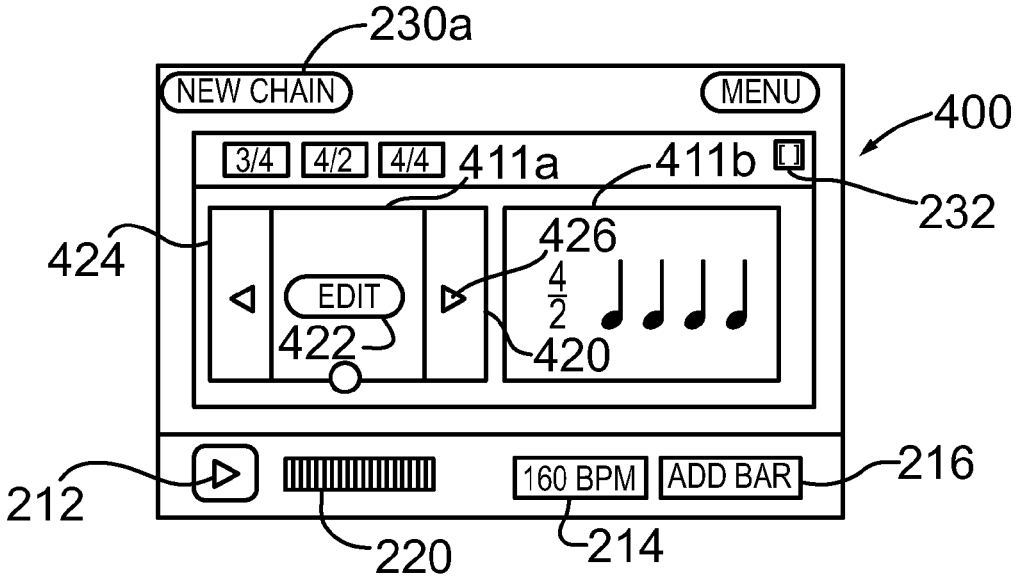
FIG. 4 is a screenshot of a chain screen configured with a chain or mix for editing or manipulation according to an embodiment of the present invention.

Reference is next made to FIG. 3, which shows a screenshot of a Load Chain view or screen indicated generally by reference 300. The Chain view screen 300 is accessed via the Load Chain control 106 on the Menu screen 100 (FIG. 1). The Chain view screen 300 is configured to display a list of the saved mixes or chains (e.g. saved in device memory). According to an embodiment, the mixes are displayed in column form with "Name" 310, "Last Date Save" 320 and a corresponding Open button or control 330. The Chain view screen 300 also includes a Cancel button 332 for returning to the calling screen, e.g. the Menu screen 100 (FIG. 1). In response to one of the Open buttons 332 being actuated (e.g. tapped), the programmable metronome is configured to retrieve the corresponding chain from memory and configure the chain view screen (for example, as shown in FIG. 4) to display the chain. As shown in FIG. 4, the chain view screen 400 displays the selected chain 411 and includes the other controls (e.g. the Play button 212, the BPM button 214, the Add bar button 216, the Volume control 220, the bar icons 230 and the Isolate bars button 232) as described above. As shown in FIG. 4, the programmable metronome 10 is configured to generate an edit overlay 420. The edit overlay 420 is configured to allow a user to edit the selected bar (e.g. the bar 411*a*), and includes an Edit control 422, and navigation controls 424, 426 to move back and forth between adjacent bars. In response to activation (e.g. tapping) of the Edit control 422, the programmable metronome is configured to invoke and display edit functions as will be described in more detail below with reference to FIGS. 5-6. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 5:
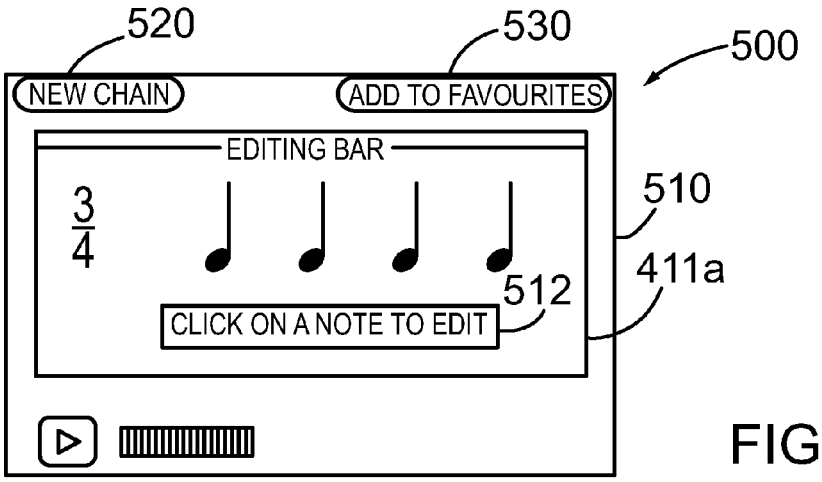
FIG. 5 is a screenshot of an Edit bar initial view screen according to an embodiment of the present invention.
Figure 6:
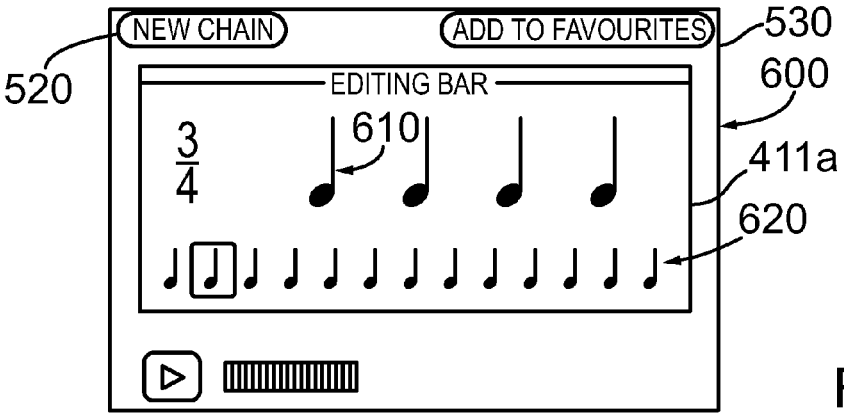
FIG. 6 is a screenshot of the Edit bar screen of FIG. 5 with a note selected according to an embodiment of the present invention.

According to an embodiment, the programmable metronome 10 is configured to display a Edit bar interface screen or view as shown in FIG. 5 and indicated generally by reference 500. The Edit bar screen 500 displays the selected bar 411*a* in an edit view 510. The Edit bar screen 500 includes a Back to Chain control 530 configured to return control to the calling view. The Edit bar screen 500 is configured to allow a user to rearrange note arrangements within the selected bar 411*a*, for example, as will be described in more detail below. The Edit bar screen 500 also includes an Add to Favourites control 530 configured to add the edited bar to a Favourites file or list. The Edit bar screen 500 includes a Note to Edit control 512. In response to actuation (e.g. tapping) of the Note to Edit control 512, the programmable metronome is configured to display an Edit bar view as shown in FIG. 6 and indicated generally by reference 600. The Edit bar view 600 is configured to allow a user to swap a selected note (or note arrangement) with a note selected or picked from a note list 620 as shown in FIG. 6. The edited bar can be added to the "Favourites" list or file by tapping the Add to Favourites control 530. The editing function is described in more detail below. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 8A:
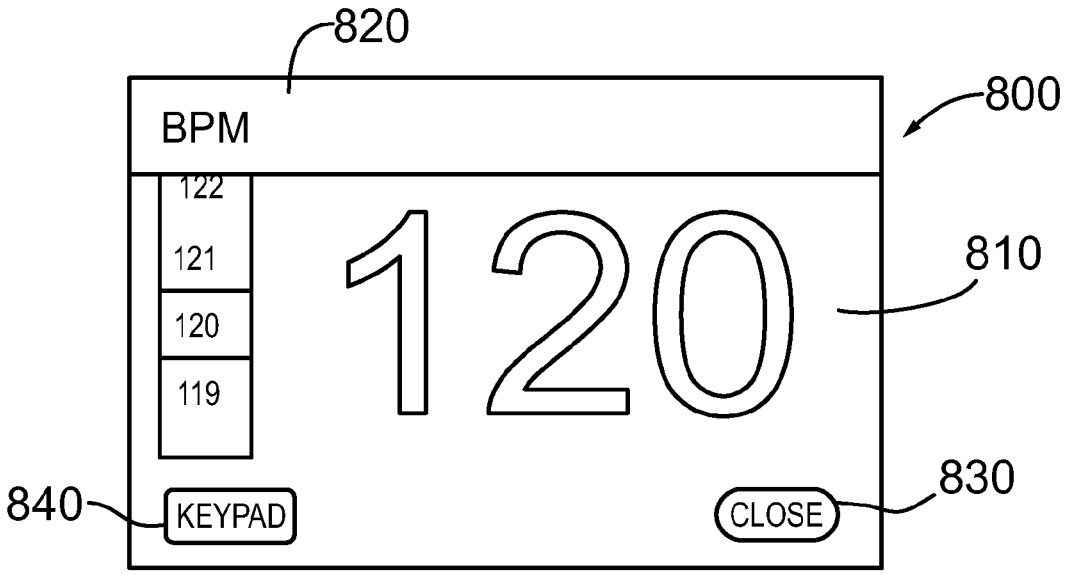
FIGS. 8(*a*) to 8(*b*) are screenshots of an Edit BPM (Beats Per Minute) parameter or setting screen according to an embodiment of the present invention.
Figure 8B:
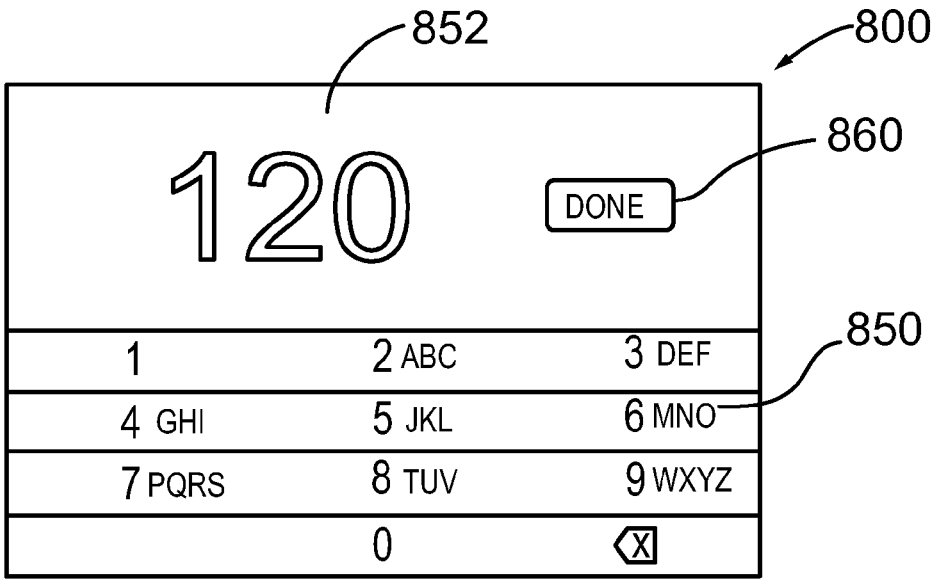

Reference is next made to FIGS. 8(*a*) and 8(*b*), which show an Edit BPM settings screen or interface according to embodiments of the present invention. The Edit BPM settings screen is indicated generally by reference 800 and is accessed in response to tapping of the BPM button, for example, the BPM button 214 in the Chain view screen 200 (FIGS. 2(*a*) to 2(*c*)). The Edit BPM settings screen 800 includes a display field or window 810 showing the current BPM setting and BPM select tool (e.g. a wheel) 820 for selecting a new BPM setting. The Edit BPM screen 800 also includes a Close button 830 for exiting the function (i.e. returning to the calling screen or view). The Edit BPM screen 800 is configured to allow a user to adjust the BPM setting by dragging the wheel 820 to the desired setting. According to another aspect, the Edit BPM screen 800 includes a Keypad button 840. Tapping the Keypad button 840 opens a keypad 850 as shown in FIG. 8(*b*). The keypad 850 is configured to allow the user to enter (i.e. type) the desired BPM setting, which is displayed in a BPM setting field 852. The BPM edit operation is ended by tapping a Done button 860. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 9:
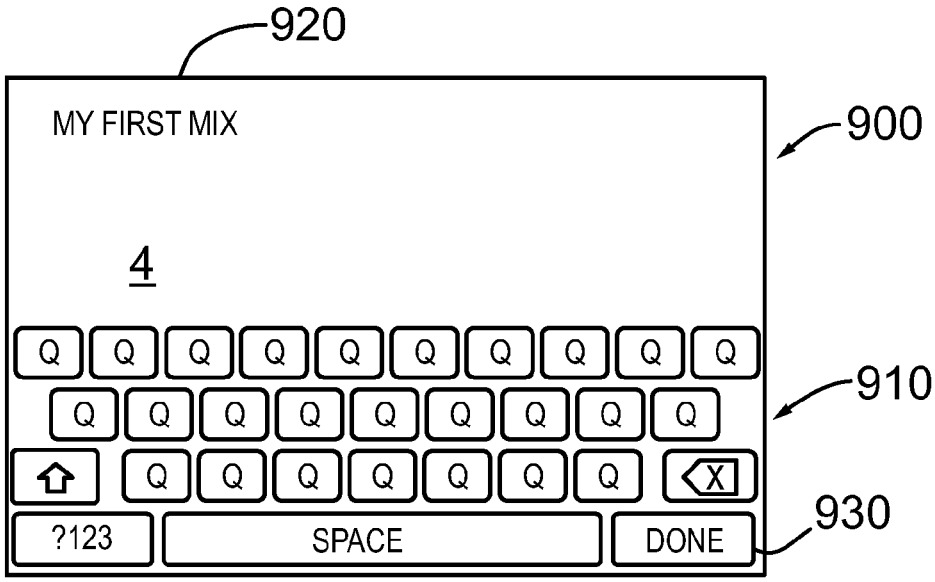
FIG. 9 is a screenshot of a Title edit screen according to an embodiment of the present invention.

Reference is next made to FIG. 9, which shows a screenshot of an Edit title screen or interface indicated generally by reference 900. The Edit title interface 900 is configured to allow a user to assign a title or label to a chain or mix. According to an embodiment, the Edit title interface 900 comprises a keyboard (for example, a QWERTY style keyboard) indicated by reference 910 and a title display line or field 920. The title is saved and the Edit title interface exited by tapping a Done button 930. According to an embodiment, the programmable metronome is configured to check if the title or label is unique across all the saved mixes. This condition is checked, for example, when the Save Current Chain button 104 (FIG. 1) is actuated. According to one aspect, if there is a naming conflict, the user is prompted to confirm an overwrite of the existing chain. According to another aspect, if there are any unsaved changes in the current mix or chain and the user initiates a Load Chain 106 (FIG. 1) operation, then the device 10 is configured to prompt the user to confirm discarding the unsaved changes. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 10A:
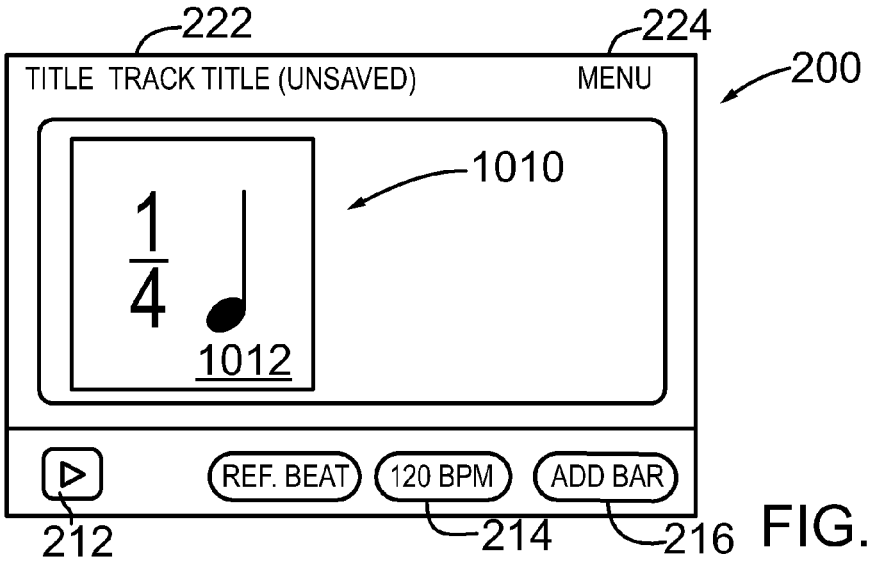
FIGS. 10(*a*) to 10(*c*) are screenshots illustrating a process or method for creating mixes with arbitrary time signatures according to an embodiment of the present invention.
Figure 10B:
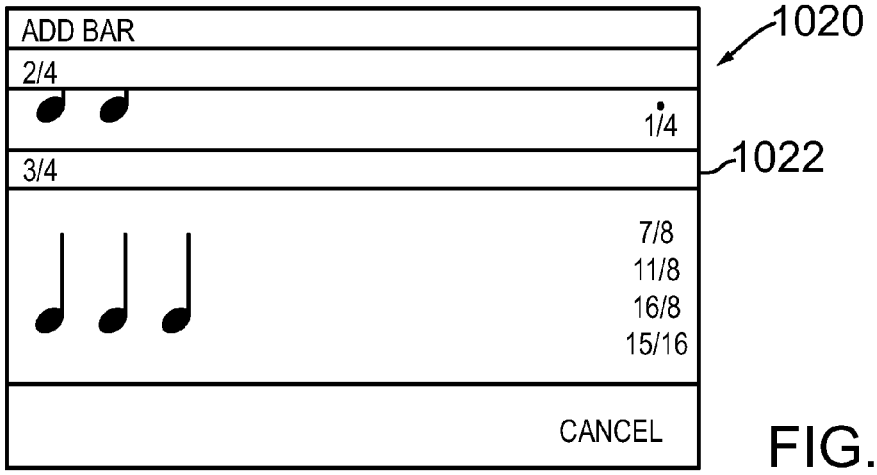
Figure 10C:
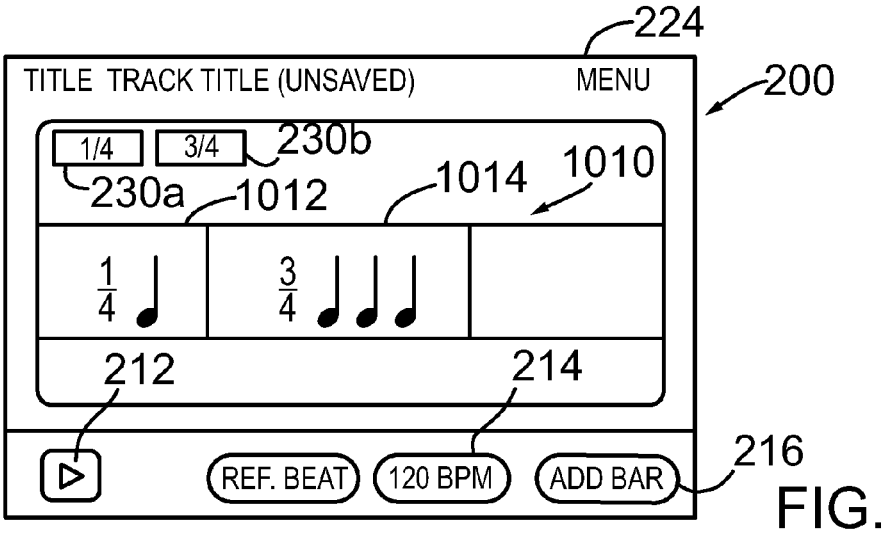

Reference to next made to FIGS. 10(*a*) to 10(*c*), which show an exemplary embodiment for a process or method for creating mixes with arbitrary time signatures according to an aspect of the present invention. According to this aspect, the programmable metronome 10 is configured to allow a user to add new bars from a list of prepackaged and saved bars when editing a mix. According to another aspect, the programmable metronome 10 is configured to allow a user to mix and match time signatures within a mix or chain as will become apparent from the following description. The Add Bar function is accessed from the Chain view screen (as described above with reference to FIG. 2) and depicted in FIG. 10(*a*). The Chain view screen 200 shows a chain or mix indicated by reference 1010 comprising a first bar (i.e. ¼ Bar) indicated by reference 1012. In response to the Add Bar button 216 being tapped, the programmable metronome displays an available bars screen or view listing the available bars indicated generally by reference 1020. According to an exemplary implementation, the available bars screen 1020 is configured with a drag and select mechanism to allow a user to scroll through the list of bars and select a bar, for example, the "¾" Bar as indicated by reference 1022 in FIG. 10(*b*). In response to double-tapping the selected ¾ Bar 1022, the ¾ Bar 1022 is inserted or appended in the chain 1010 as depicted in FIG. 10(*c*) and indicated by reference 1014, and the available bars screen 1020 is closed. As also shown in FIG. 10(*c*), a corresponding bar icon 230*b* is generated and displayed for the newly added bar 1014. The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 11A:
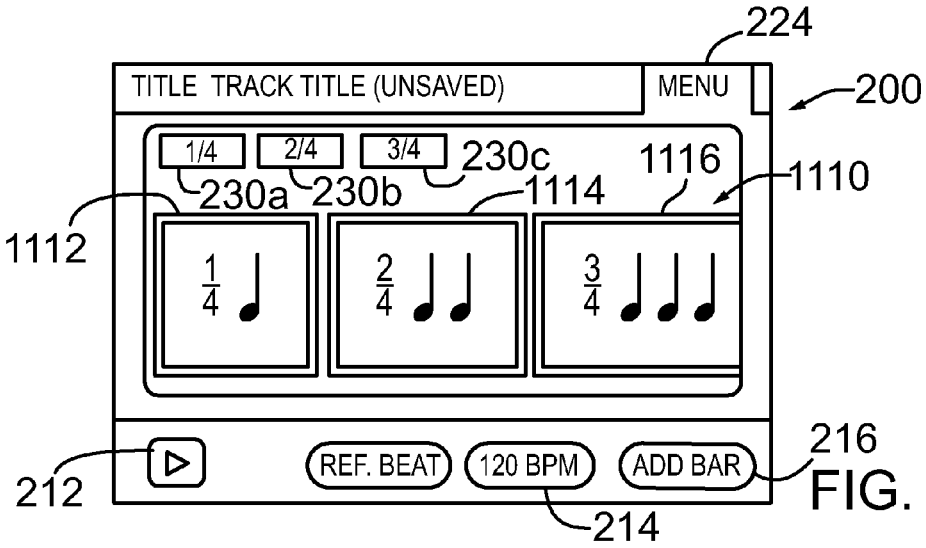
FIGS. 11(*a*) to 11(*b*) are screenshots illustrating a process or method for rearranging bars within a chain or mix according to an embodiment of the present invention.
Figure 11B:
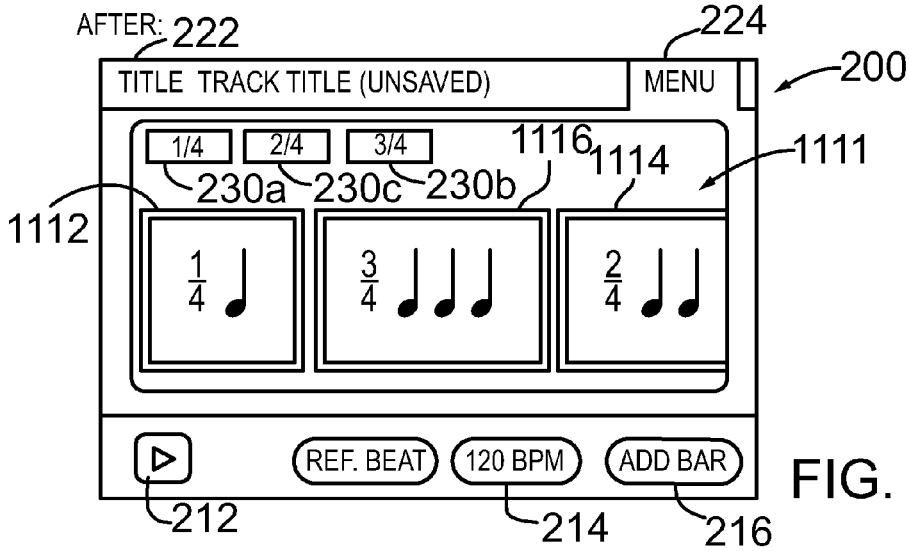
Figure 12A:
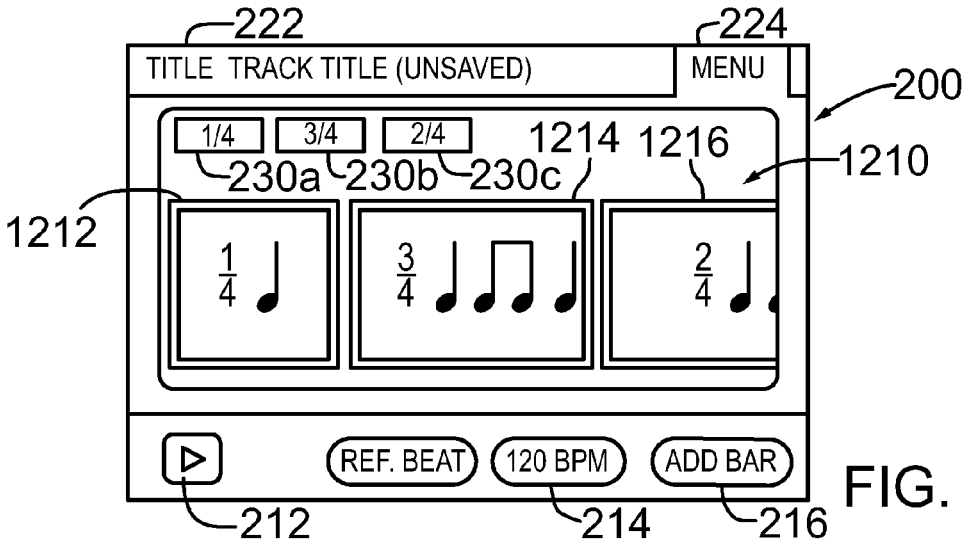
FIGS. 12(*a*) to 12(*e*) are screenshots illustrating a process or method for rearranging notes within a bar according to an embodiment of the present invention.
Figure 12B:
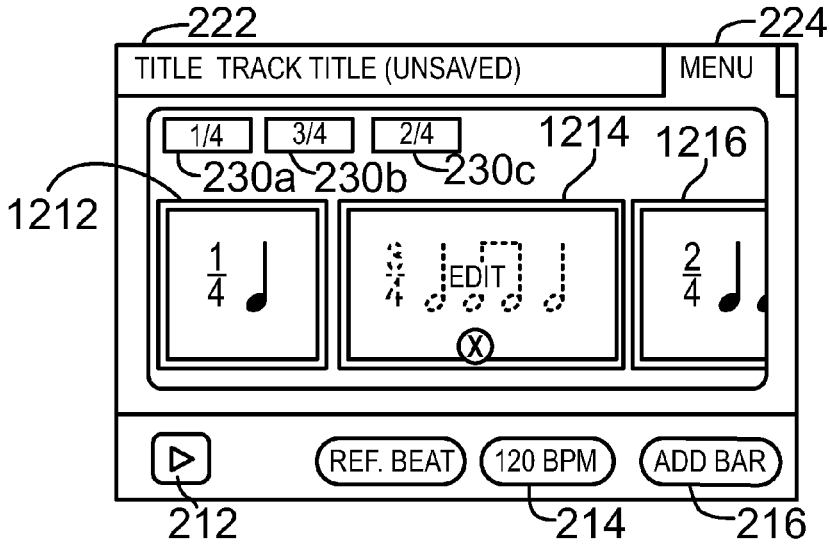
Figure 12C:
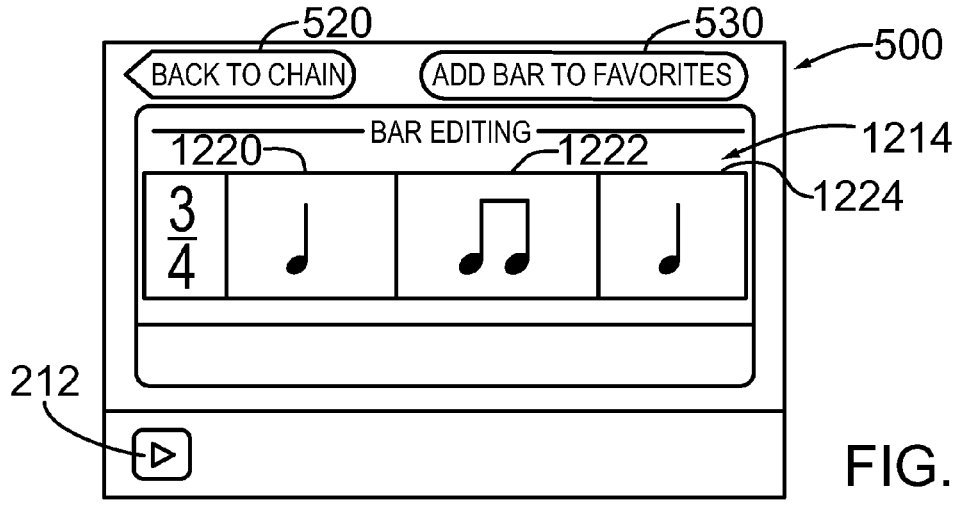
Figure 12D:
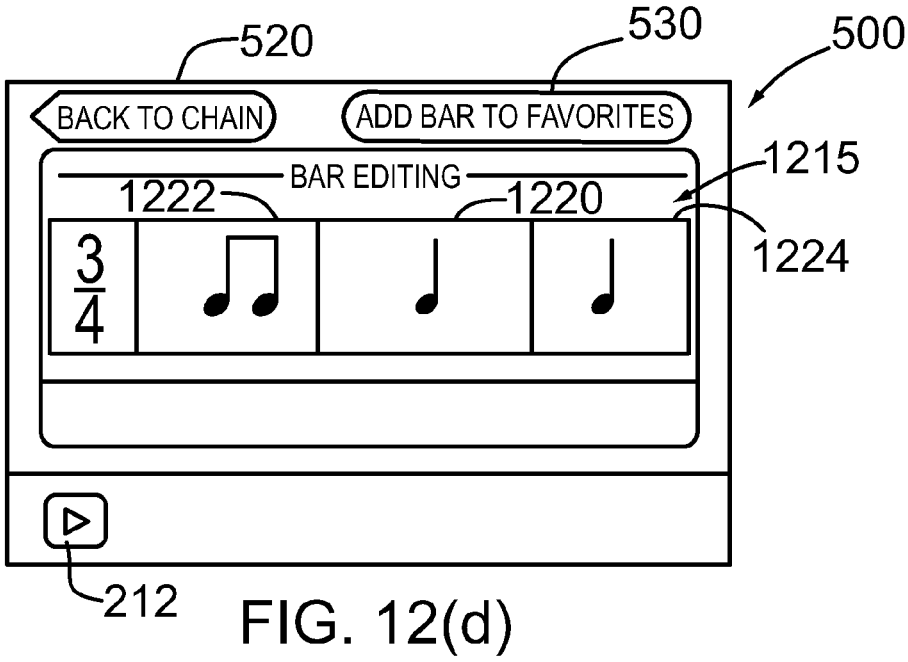
Figure 12E:
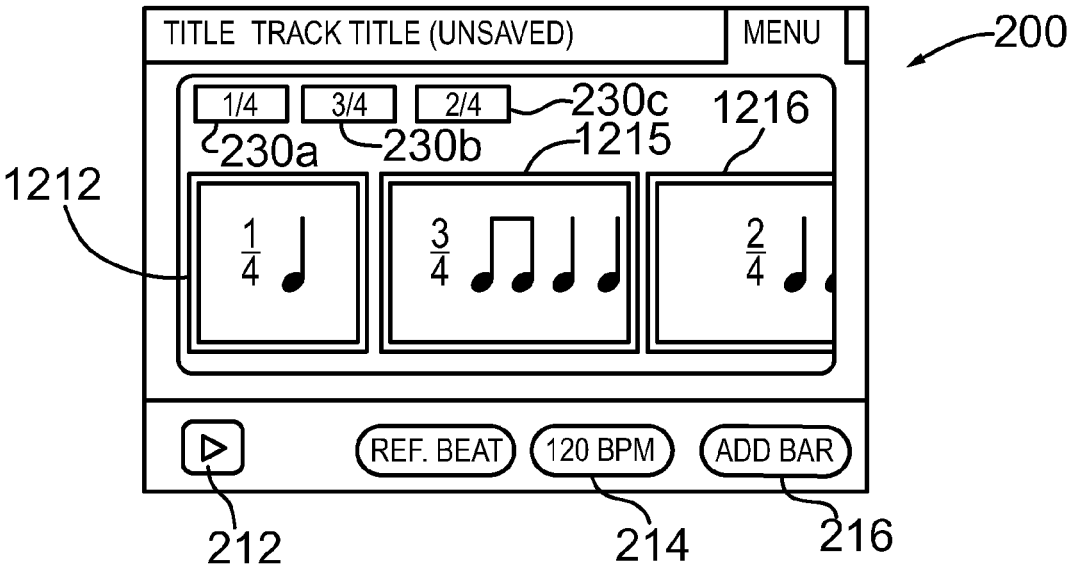

Reference is next made to FIGS. 11(*a*) to 11(*b*), which show an exemplary embodiment for a process or method for rearranging bars within a chain or mix according to an embodiment of the present invention. According to this aspect, the programmable metronome 10 is configured to allow a user to rearrange the order of the bars in a chain or mix (comprising 2 or more bars). According to an exemplary implementation, the rearrange function incorporates a dragging-and-dropping mechanism. According to another aspect, the rearrange function is configured to respond to the dragging of the selected bar by shifting the other bars left or right depending on the position of the dragged selected bar. According to this aspect, the order of the other bars is not changed, and the dragged bar is shifted left or right. FIG. 11(*a*) comprises a view of the Chain view screen 200 displaying a chain or mix 1110 comprising from left to right a ¼ Bar 1112, a ¾ Bar 1114 and a ¾ Bar 1116. In response to the drag-and-drop operation, a new chain or mix indicated by reference 1111 is formed comprising the ¼ Bar 1112 followed by the ¾ Bar 1116 and the ¾ Bar 1114. The bar icons 230 are also rearranged accordingly. The other controls are available for the rearranged mix 1111, such as, the play function 212, the Edit BPM function 214, the Add Bar function 216, the edit Title function (e.g. tapping the Title button 222), and the Save Current Chain function 104 via the Menu function 224. The functionality associated with these feature can be implemented in software or executable computer code, code components or objects executed by the processor or microcontroller or other type of computing device imbedded or integrated with the programmable metronome, and the particular implementation and coding details will be within the understanding of one skilled in the art.

Reference is next made to FIGS. 12(*a*) to 12(*e*), which illustrate a process or method for rearranging notes within a bar according to an embodiment of the present invention. According to this aspect, the programmable metronome 10 is configured to allow a user to rearrange note arrangements within a bar. In this example, FIG. 12(*a*) comprises a view of the Chain view screen 200 displaying a chain or mix 1210 comprising from left to right a ¼ Bar 1212, a ¾ Bar 1214 and a ¾ Bar 1216. In response to "tapping" the ¾ Bar 1214, the Edit button or control 420 (for example, see FIG. 4 above) is generated/displayed as depicted in FIG. 12(*b*). Next in response to tapping the Edit control 420, the Edit Bar interface or view 500 (for example, see FIG. 5) is generated/displayed as depicted in FIG. 12(*c*). According to this aspect, the Edit Bar interface 500 is configured to allow notes to be rearranged using a "drag-and-drop" touch gestures. In this example, the ¾Bar 1214 comprises a quarter note 1220, two eighth notes 1222 and a quarter note 1224. As shown in FIG. 12(*d*), using drag-and-drop, the two eighth notes 1222 are moved to the left and the quarter note 1220 is shifted to the right generating a modified bar indicated by reference 1215. The modified bar 1215 can be added to the "Favourites" list (as described above) by tapping the Add Bar to Favourites button 530. In response to tapping the Back to Chain button 520, the rearranged bar 1215 is inserted into the chain 1210 and displayed in the Chain View screen 200 as depicted in FIG. 12(*e*). The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

Figure 13A:
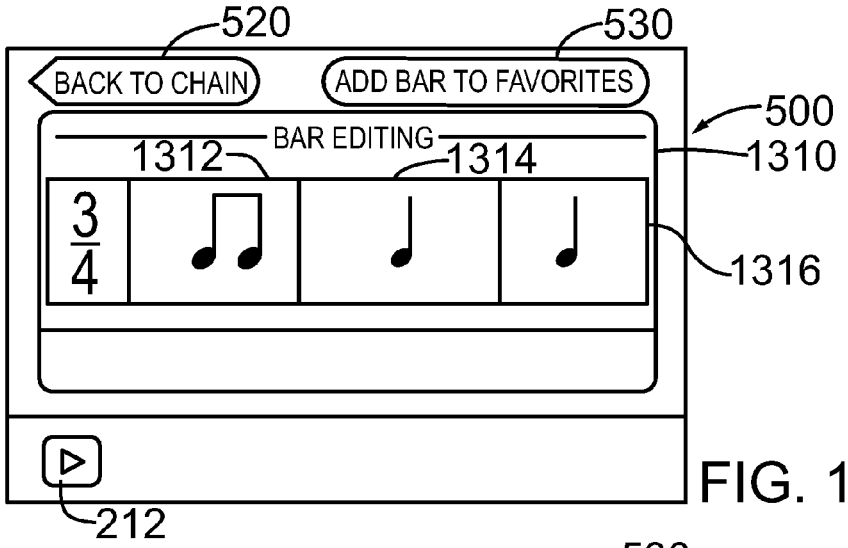
FIGS. 13(*a*) to 13(*c*) are screenshots illustrating a process or method for substituting note arrangements according to an embodiment of the present invention.
Figure 13B:
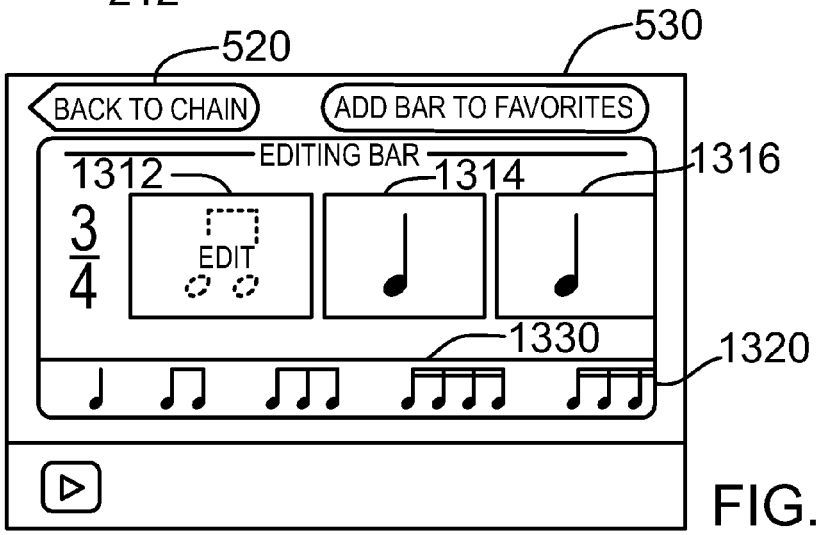
Figure 13C:
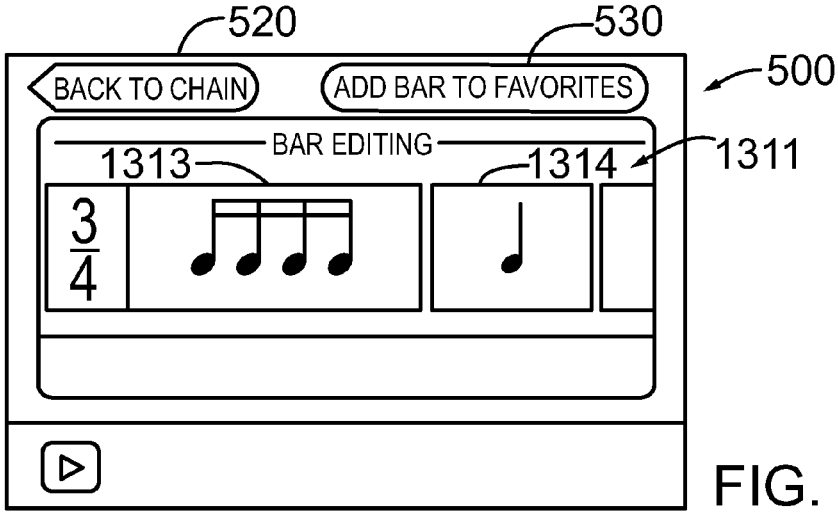

Reference is next made to FIGS. 13(*a*) to 13(*c*), which illustrate a process or method for substituting note arrangements according to an embodiment of the present invention. In this example, FIG. 13(*a*) comprises an Edit Bar Interface or screen 500 displaying a ¾ bar 1310 comprising from left to right: two eighth notes 1312, a quarter note 1314 and another quarter note 1316. In response to "tapping" of the two eighth notes 1312, the Edit button or control 420 is generated/displayed together with a list of available notes 1320, as depicted in FIG. 13(*b*). According to an embodiment, the note list 1320 is responsive to tapping. In this example, four sixteenth notes indicated by reference 1330 are selected and substituted into the bar as indicated by reference 1313 to generate a modified bar 1311 as depicted in FIG. 13(*c*). The modified bar 1311 can be added to the "Favourites" list (as described above) by tapping the "Add Bar to Favourites" button 530, and/or the modified bar 1311 can be inserted into the chain and displayed in the Chain View screen 200 by tapping the Back to Chain button 520 (FIG. 13(*c*)). The functionality associated with these features can be implemented in software or executable computer code, code components or objects executed by the processor or microcontroller or other type of computing device imbedded or integrated with the programmable metronome, and the particular implementation and coding details will be within the understanding of one skilled in the art.

According to another aspect, the programmable metronome 10 includes a mechanism for note arrangement compression. The note arrangement compression mechanism comprises a process whereby musical notation, for example, rests are grouped together to provide syntactically correct musical notation as will be understood and expected by a musician, teacher or student. According to another aspect, the mechanism includes a process for drawing the graphical display images of the musical notation, which takes into account the context of the individual notes within the arrangement.

Figure 14A:
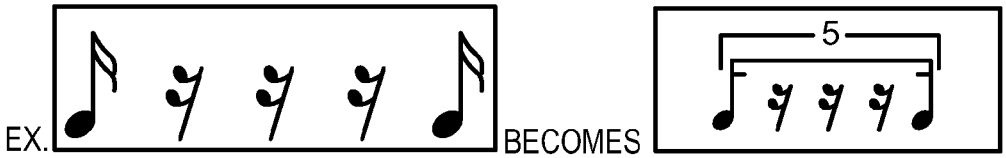
FIG. 14 shows exemplary note compressions display images according to an embodiment of the present invention.
Figure 14B:
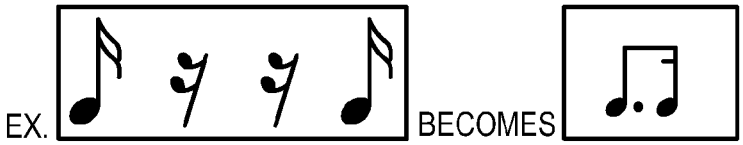

According to an embodiment, the note arrangement compression process takes into account the type of note arrangement as follows:

- triplets, quintuplets, sextuplets and septuplets are not compressed
- rests within the arrangement are included as part of the resulting image (for example, as shown in FIG. 14(*a*))
- for quadruplets, octuplets and pairs of eight notes, the rests are compressed and the display image is generated, for example, as shown in FIG. 14(*b*)

According to an embodiment, the note arrangement compression process can be implemented in software or executable code in a form as generally illustrated by the following exemplary pseudo-code:

```
Given a note arrangement,
if (arrangement is a single note, triplet, quintuplet, sextuplet, or septuplet)
then
  return the original arrangement;
else
  beginning with the first note in the arrangement, iterate over the notes:
    if (on the first note in the arrangement) then
      save its type (rest, accented note, etc) and
      accumulate its duration
    else
      if (the current note is a rest) then
        accumulate its duration
      else
        if (the accumulated duration at the time of deposit is
        equivalent to five sixteenth notes) then
          split the note or rest to be deposited into a
          note + rest or a rest + rest, respectively (of
          lengths four sixteenth notes and one
          sixteenth note)
        else
```

-continued

```
          deposit any accumulated time as a single
          note of the type saved above
  when done iterating, return the resulting, deposited (i.e. compressed)
  notes.
```

According to another aspect, the programmable metronome 10 includes a mechanism for drawing graphical representations of note arrangements for display on the image display screen of the programmable metronome device, e.g. the touch sensitive display screen on an iPHONE™ device. According to an embodiment, each note is evaluated in the context of the previous note and the next note in the arrangement, and the number of flags on the notes is taken in consideration. For each note, a "flag pair" object is generated, which denotes the number of flags on the left and the right of a given note. The graphical representation of the flags for an arrangement is generated by iterative processing of a sorted list of flags, as described in more detail by the following exemplary pseudo-code:

```
Given a compressed note arrangement,
if (arrangement contains a single note) then
  draw the single note and return the constructed image
else
  if (arrangement is a triplet, quintuplet, sextuplet, septuplet) then
    initialize an empty list of flag pairs
    iterate over the notes, from beginning to end, and generate flag
    pairs such that,
      all leading rests as stand-alone rests (i.e. with no flags)
      all notes and rests between the first and the last note
      (inclusive) are connected by a single (top-most) flag
      all notes with the appropriate leading and trailing flags,
      rests are drawn with no additional flags
      all notes after the last note are drawn as stand-alone rests
```

Note: there are two cases to consider when drawing a musical note:

(i) if the previous note was a rest, then only draw the current note with a single leading flag, (ii) if the next note is a rest, then only draw a single trailing flag ONLY IF the current note's leading flags match its duration iterate through the list of flag pairs and generate images for each note, returning the constructed image else Note: a three-pass system is implemented to determine how the notes (and their respective flags) are to be drawn. It will be appreciated that the implementation can be modified to a two-pass system, albeit with more complexity.

```
Pass 1: determine where the first/last notes (i.e. non-rests) are by iterating
over the list of notes in the compressed note arrangement (for example,
see above), which determines whether a single flag needs to be drawn to
connect the notes in the arrangement; denote the indices of these first and
last notes as "firstNoteWithFlagIndex" and "lastNoteWithFlagIndex",
respectively
Pass 2: initialize and generate an array offlag-pairs for each note in the
arrangement:
  iterate over each note in the compressed arrangement, denoting
  the current index as I, generating flag-pairs consistent with the
  following:
    if i < firstNoteWithFlagIndex OR
    i >lastNoteWithFlagIndex OR
    (i = firstNoteWithFlagIndex AND
    i = lastNoteWithFlagIndex) then
      note is a solo note,
```

-continued

```
    left flags = none,
    right flags = none if the note is a rest; otherwise,
    right flags = # consistent for note duration
  else if i = firstNoteWithFlagIndex
    note is at the beginning of a sequence of notes that
    are to be connected by (at least) a single flag,
    left flags = none,
    right flags = none if the note is a rest; otherwise,
    right flags = # consistent for note duration
  else if i = lastNoteWithFlagIndex
    note is at the end of a sequence of notes that are to
    be connected by (at least) a single flag,
    if the previous note had no flags, then this note is
    treated as above when
    i = firstNoteWithFlagIndex
    otherwise, right flags = 0, left flags = # consistent
    for note duration
  else
    note is in the middle of a sequence
    if note is a rest
      left flags = 1,
      right flags = 1
    else
      left flags = the lesser of the current note's
      flags (i.e. appropriate for its duration) and
      the leading note's flags,
      right flags - if the next note is at the end of
      the arrangement, then the trailing flag is not
      drawn if the next note's duration requires
      fewer flags and there are sufficient leading
      flags connecting the current note with the
      previous note. Otherwise, the appropriate
      number of right flags are drawn for the note.
Pass 3: iterate over the array generated in Pass 2 and draw the graphical
display image for each note
```

The particular implementation and coding details will depend on the specific computing devices or platforms and will be readily apparent to one skilled in the art.

While the programmable metronome is described in the context of a software application that is configured to run on a mobile or handheld device such as the iPHONE™ or iPOD™ or iPAD™ from Apple Corporation, it will be appreciated that the programmable metronome has wider applicability and can be configured to run, in whole or in part, on other computing platforms, machines and systems whether portable or desktop, or as a standalone device, or in combination or integrated with other types of musical instruments or effects devices or machines.

The present invention may be embodied in other specific forms without departing from its spirit or essential characteristics. The embodiments described and disclosed are to be considered in all aspects only as illustrative and not restrictive. The scope of the invention is, therefore, indicated by the appended claims rather that by the foregoing description. All changes which come within the meaning and range of equivalency of the claims are to be embraced within their scope.

What is claimed is:

1. A rhythm trainer device comprising:

a display module comprising a chain view screen configured to display a music chain;

said music chain comprising a plurality of bar objects, and each of said bar objects comprising a plurality of note objects;

said chain view screen comprising a touch sensitive component configured to be responsive to a user touch gesture to select one of said plurality of bar objects;

an edit view screen configured to display said selected bar object, and said edit view screen being configured to manipulate one or more of said plurality of note objects comprising said selected bar object; and wherein said edit view screen comprises a touch sensitive component and said plurality of note objects being configured to be responsive to user touch gestures.

2. The rhythm trainer device as claimed in claim 1, wherein said chain view screen comprises an add bar object comprising a touch sensitive component, and said add bar object being configured to insert one or more new bar objects to said music chain in response to a user touch gesture, and wherein said new bar objects comprise different time signatures.

3. The rhythm trainer device as claimed in claim 2, wherein said chain view screen comprises a drag and drop mechanism and said plurality of bar objects are configured to be responsive to user touch gestures for repositioning one or more of said plurality of bar objects in said music chain.

4. The rhythm trainer device as claimed in claim 1, wherein said chain view screen comprises an edit overlay component, said edit overlay component being configured to edit said selected bar object, and further comprising navigation controls configured to move said edit overlay component between adjacent bar objects.

5. The rhythm trainer device as claimed in claim 2, further comprising an edit bar screen, said edit bar screen being configured to substitute a note arrangement object in said selected bar object with another note arrangement object, wherein each of said note arrangement objects comprises one or more of said note objects.

6. The rhythm trainer device as claimed in claim 1, wherein said chain view screen comprises a drag and drop mechanism and said plurality of note objects are configured to be responsive to user touch gestures for repositioning one or more of said plurality of note objects in said selected bar object.

7. A computer program product stored on a tangible machine readable medium, and comprising computer readable instructions for:

generating a chain view screen configured to display a music chain, said music chain comprising a plurality of bar objects, and each of said bar objects comprising a plurality of note objects;

selecting one of said plurality of bar objects in response to a user touch gesture;

generating an edit view screen configured to edit said selected bar object;

manipulating one or more of said plurality of note objects in said selected bar object in response to one or more user touch gestures; and storing said music chain with said edited bar objet in memory.

8. The computer program product as claimed in claim 7, further including adding one or more new bar objects to said music chain in response to one or more user gestures, and wherein said one or more new bar objects comprise different time signatures.

9. The computer program product as claimed in claim 7, further including generating an edit overlay configured to edit said selected bar object.

10. The computer program product as claimed in claim 7, further including generating an edit bar screen, said edit bar screen being configured to substitute a note arrangement object in said selected bar object with another note arrangement object, and wherein each of said note arrangements comprises one or more of said note objects.

* * * * *